United States Patent [19]

Scardenzan

[11] 4,130,320

[45] Dec. 19, 1978

[54] WHEEL FOR ROLLER SKATE OR SKATEBOARD

[76] Inventor: Anthony Scardenzan, 269 N. Hillcrest Blvd., Inglewood, Calif. 90301

[21] Appl. No.: 745,789

[22] Filed: Nov. 29, 1976

Related U.S. Application Data

[63] Continuation-in-part of Ser. No. 628,048, Nov. 3, 1975, abandoned.

[51] Int. Cl.[2] ..... A63C 17/22

[52] U.S. Cl. ..... 301/5.7; 301/63 PW

[58] Field of Search ..... 301/5.3, 5.7, 63 PW; 152/324, 7, 353 R, 209 R, 352, 323, 325

[56] References Cited

U.S. PATENT DOCUMENTS

| | | | |
|---|---|---|---|
| 1,348,200 | 8/1920 | Beaumont | 152/352 X |
| 2,664,317 | 12/1953 | Glynn et al. | 301/5.3 |
| 3,666,322 | 5/1972 | Pickron | 301/63 PW |
| 3,815,959 | 6/1974 | Hill | 301/63 PW |
| 3,895,844 | 7/1975 | Merbler | 301/5.7 |
| 3,905,649 | 9/1975 | Kosono et al. | 301/5.7 |
| 3,912,332 | 10/1975 | Jones | 301/5.7 |
| 3,915,774 | 10/1975 | Dobson | 152/323 X |

FOREIGN PATENT DOCUMENTS

| | | | |
|---|---|---|---|
| 572780 | 3/1959 | Canada | 301/5.7 |
| 597169 | 5/1934 | Fed. Rep. of Germany | 152/324 |
| 1027542 | 4/1958 | Fed. Rep. of Germany | 152/323 |
| 708976 | 5/1931 | France | 152/352 |
| 28517 of | 1907 | United Kingdom | 152/209 R |
| 4915 of | 1909 | United Kingdom | 152/209 R |
| 229745 | 2/1925 | United Kingdom | 301/5.7 |
| 530139 | 12/1940 | United Kingdom | 301/5.7 |
| 857866 | 1/1961 | United Kingdom | 301/63 PW |

*Primary Examiner*—Robert B. Reeves
*Assistant Examiner*—Charles A. Marmor
*Attorney, Agent, or Firm*—Keith D. Beecher

[57] ABSTRACT

A roller skate wheel for roller skate, or skateboard use, is provided which is formed of an appropriate yieldable plastic material, such as polyurethane, or other suitable material, which is hard but not brittle, and which will deform when subjected to an impact force. Moreover, the plastic material is such that it will instantly restore itself to its original shape after the force has been removed, and it will not acquire a permanent set in a deformed condition. In accordance with the invention, the gripping capabilities of the wheel are enhanced by the provision of a plurality of spaced peripheral grooves in the rim of the wheel, which form a corresponding plurality of peripheral ribs. A pair of side grooves are also provided in the rim of the wheel adjacent to the peripheral surface to permit the end ribs to bend outwardly and improve the grip of the wheel, especially during turning or cornering. One or more self-contained bearings are imbedded concentrically within the plastic rim of the wheel to permit easy change from one type of wheel to another. The peripheral surface of the rim has either a straight, concave or convex configuration, depending upon the use to which the skate or skateboard is to be put.

2 Claims, 7 Drawing Figures

FIG. 1
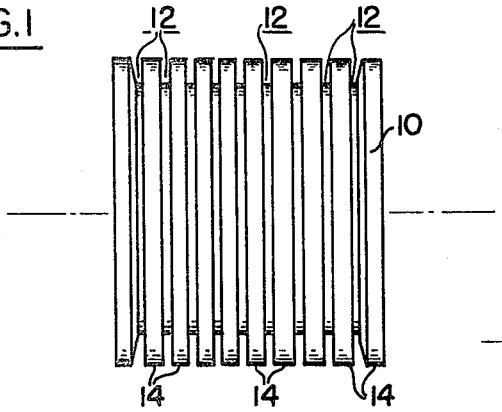
FIG. 2
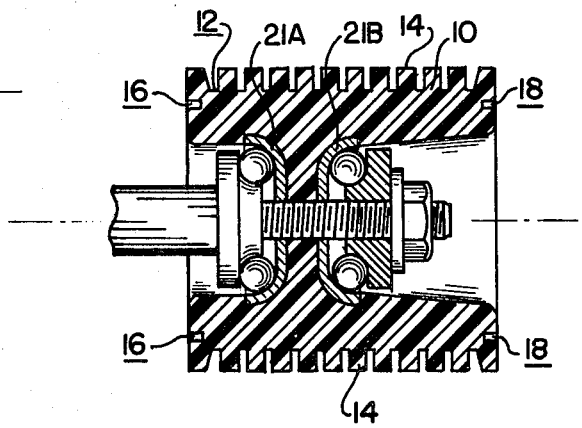
FIG. 3
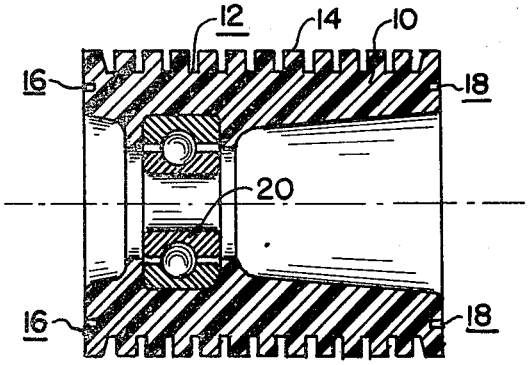
FIG. 4
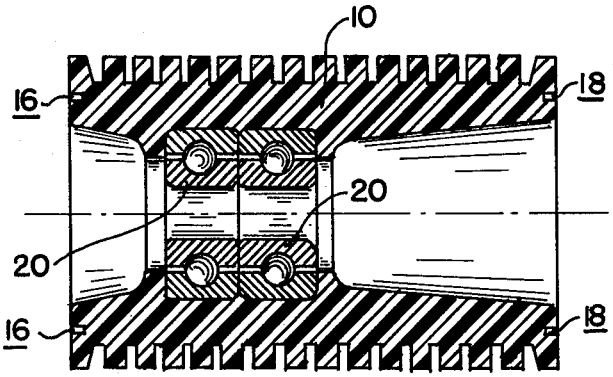
FIG. 7
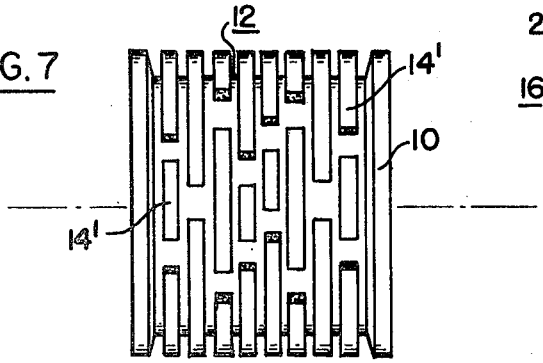
FIG. 6
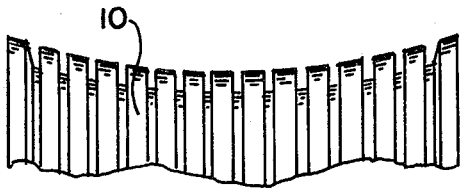
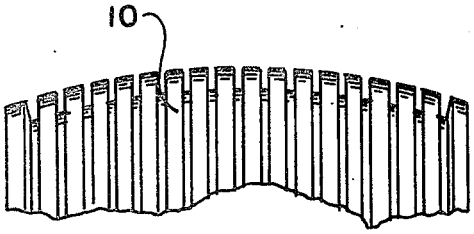
FIG. 5

WHEEL FOR ROLLER SKATE OR SKATEBOARD

This application is a continuation in-part of copending application Ser. No. 628,048 filed Nov. 3, 1975, now abandoned.

BACKGROUND OF THE INVENTION

Prior to the advent of the polyurethane roller skate wheel, problems had been encountered in the prior art in the attempts to replace the noisy, expensive and unsatisfactory metal and wooden roller skate wheels with plastic composition wheels. The original plastic composition wheels were often extremely hard and brittle, because an excessive amount of harsh abrasive was used in the composition in order to provide the wheels with an acceptable amount of sliding friction. Accordingly, such prior art wheels had the tendency to chip or crack when subjected to impacts, and they also failed to exhibit the degree of resilience necessary to assure skating comfort and control.

The present-day polyurethane wheel overcomes the defects inherent in the prior art plastic composition wheels in that although hard, they are not brittle, and they exhibit the desired degree of yieldability required in roller skate wheels. However, the polyurethane wheel does not normally exhibit the gripping capabilities of the less desirable prior art wheels. Accordingly, an important object of the present invention is to provide an improved construction for plastic roller skate wheels, for example, of the polyurethane type, which provides a desired high degree of gripping capability thereto without in any way diminishing the favorable characteristics thereof, such as described above, and which contain one or more self contained bearings imbedded concentrically within the plastic rim to permit easy wheel change.

BRIEF DESCRIPTION OF THE DRAWING

FIG. 1 is an end view of a roller skate wheel grooved in accordance with one of the aspects of the invention to provide treads so as to improve its gripping capabilities;

FIG. 2–6 are side sections of the grooved roller skate wheel representing different embodiments of the invention; and FIG. 7 is a view, like FIG. 1, of a roller skate wheel, in which the treads are discontinuous.

DETAILED DESCRIPTION OF THE ILLUSTRATED EMBODIMENTS

The wheel assembly illustrated in the drawings includes a rim section 10 formed of plastic material, such as polyurethane, or other suitable material, and having a series of spaced grooves 12 extending around its peripheral surface, and which define a corresponding plurality of ribs 14 which grip the surface on which the wheel is used. As shown in FIG. 1, the width of the individual grooves 12 is less than the width of the corresponding ribs 14, so that the gripping capabilities of the surface are optimized.

In the sectional view of FIG. 2, a high speed type of wheel is provided which may, for example, have an outer diameter of 2½ inches, and a length of 1¼ inches. In addition to the grooves 12, a further groove 16 is formed on one end of the rim section adjacent its peripheral surface, and yet a further groove 18 is formed in the other end of the rim section, likewise adjacent its peripheral surface. The grooves 16 and 18 permit the end ribes to bend outwardly during maneuvering of the skate, or skateboard, so as to maintain a firm grip on the supporting surface to prevent side sliding of the skate, or skateboard.

A self-contained open bearing having outer races 21A, 21B is concentrically imbedded within the rim section 10 in the embodiment of FIG. 2, with the ends of the races engaging spaced annular shoulders formed on the bore surface of the rim section, as shown. This construction facilitates wheel changes, since a change can be effectuated merely by unthreading and threading nuts from the skate axle, so that a variety of wheels may be provided for each set of skates, and changed at will.

The rim section 10, as illustrated, overhangs the ends of the bearing, with the overhang being greater at the outside of the wheel than at the inside, so as to provide a degree of flexibility to the wheel during turns, cornering, or the like, of the skate or skateboard.

The wheel of FIG. 3 is generally similar to the wheel of FIG. 2, and has been designated by the same numerals. A self-contained bearing 20 is imbedded in the rim section 10 in the embodiment of FIG. 3, to facilitate wheel changes. The bearing 20 is interposed between two axially spaced annular shoulders formed on the bore surface of the rim section, as shown. The wheel of FIG. 3 is a regular all-purpose wheel, and it has, for example, an outer diameter of 1⅞ inches and a length of 1½ inches.

The wheel of FIG. 4 represents another general purpose wheel, similar to that of FIG. 3, and again the components have been designated by the same numbers. The wheel of FIG. 4, for example, may have an outer diameter of 2 inches, and a length of 2¼ inches. It includes two bearings 20 positioned in side-by-side relationship, as shown, the bearings heing imbedded in the rim 10 of the wheel for easy wheel changes. The bearings 20 are interposed between two axially spaced annular shoulders formed on the bore surface of the rim section, as shown.

The wheel of FIG. 5 is similar to that of FIG. 4, except that the peripheral surface has a convex configuration, as shown, for speed racing. The embodiment of FIG. 6, on the other hand, is likewise similar to that of FIG. 4, but the peripheral surface has a concave configuration to facilitate acrobatics.

As mentioned above, the rim section of the wheel may be made of polyurethane, or other suitable material. The rims, for example, may be injection molded or cold poured, or other appropriate fabrication processes may be used. The ribs 14 may be interrupted, if so desired, as designated 14' in FIG. 7, and other tread configurations, such as diamond-shaped, or the like, may be used.

The invention provides, therefore, an improved roller skate which has all the desirable features of the present-day polyurethane skate, but which has enhanced surface gripping capabilities.

While particular embodiments of the invention have been shown and described, modifications may be made. It is intended in the claims to cover the modifications which come within the spirit and scope of the invention.

What is claimed is:

1. A roller skate wheel assembly comprising: a wheel formed of one piece of plastic material having a bore extending therethrough with a pair of axially spaced annular shoulders formed on the bore surface, and having a series of spaced grooves extending around the outer peripheral surface of the wheel to define a corresponding series of surface-gripping ribs, and having at least one further groove formed in at least one end thereof adjacent to said peripheral surface to permit the outer edge of the wheel to turn radially inwardly when the assembly is in use; at least one bearing embedded in the bore of said plastic wheel between said annular shoulders and contained in said bore in concentric relationship therewith, the wheel extending axially beyond both ends of the bearing with the extension beyond the outer end of the bearing being substantially greater than the extension beyond the inner end of the bearing, and the peripheral surface of the wheel having a concave configuration.

2. A roller skate wheel assembly comprising: a wheel formed of one piece of plastic material having a bore extending therethrough with a pair of axially spaced annular shoulders formed on the bore surface, and having a series of spaced grooves extending around the outer peripheral surface of the wheel to define a corresponding series of surface-gripping ribs, and having at least one further groove formed in at least one end thereof adjacent to said peripheral surface to permit the outer edge of the wheel to turn radially inwardly when the assembly is in use; at least one bearing embedded in the bore of said plastic wheel between said annular shoulders and contained in said bore in concentric relationship therewith, the wheel extending axially beyond both ends of the bearing with the extension beyond the outer end of the bearing being substantially greater than the extension beyond the inner end of the bearing, and the peripheral surface of the wheel having a convex configuration.

* * * * *